US007500629B2

(12) United States Patent
Abramson et al.

(10) Patent No.: US 7,500,629 B2
(45) Date of Patent: Mar. 10, 2009

(54) SHREDDER BLADE AND METHOD OF MANUFACTURING SAME

(76) Inventors: Aron Abramson, 2025 East 9 St., Brooklyn, NY (US) 11223; Charles Sued, 3360 Bedford Ave., Brooklyn, NY (US) 11210; Shen Tao Ou, No. 5, Lane 3, Jiu Ju Road, LongXi Village, LongJing Xiang, TaiChung Hsein (TW)

( * ) Notice: Subject to any disclaimer, the term of this patent is extended or adjusted under 35 U.S.C. 154(b) by 0 days.

(21) Appl. No.: 11/551,472

(22) Filed: Oct. 20, 2006

(65) Prior Publication Data

US 2008/0093491 A1 Apr. 24, 2008

(51) Int. Cl.
*B02C 18/16* (2006.01)

(52) U.S. Cl. ..... 241/295; 241/236

(58) Field of Classification Search ..... 241/295, 241/236, 100

See application file for complete search history.

(56) References Cited

U.S. PATENT DOCUMENTS 5,511,729 A * 4/1996 Husain ..... 241/46.01

* cited by examiner

*Primary Examiner*—Mark Rosenbaum
(74) *Attorney, Agent, or Firm*—Garcia-Zamor IP Law; Ruy M. Garcia-Zamor

(57) ABSTRACT

A shredder blade for cross cutting material fed into a shredder and method of manufacturing same.

13 Claims, 6 Drawing Sheets

FIG. 4
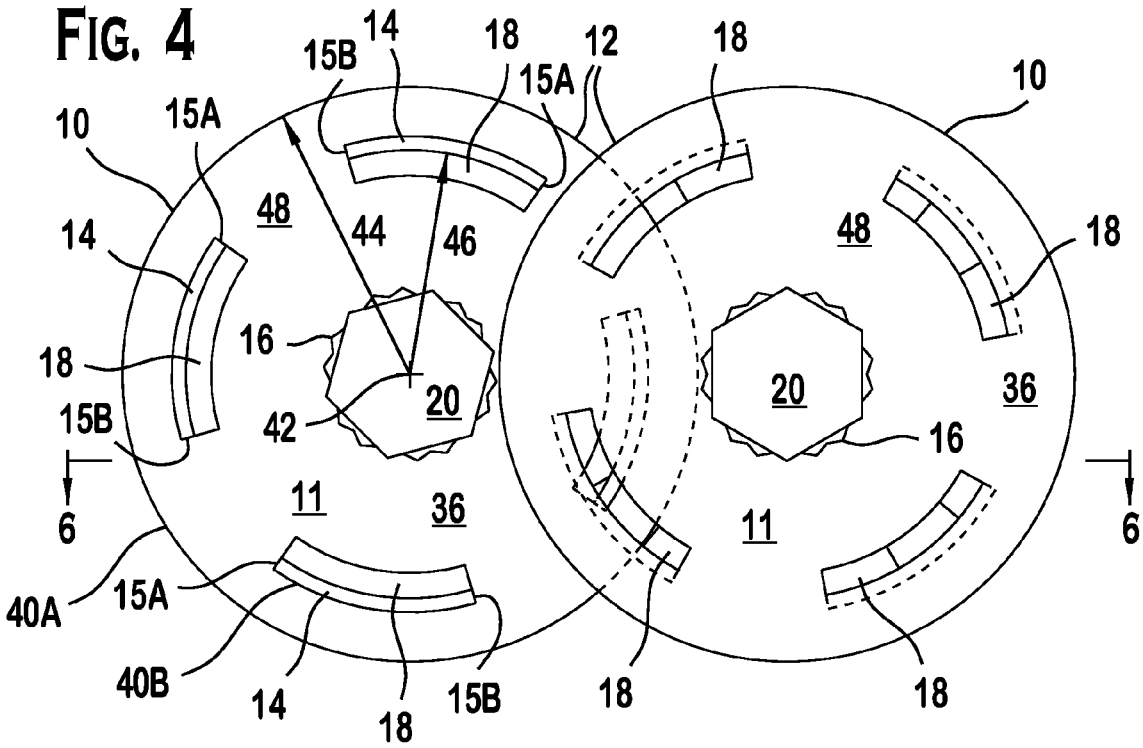
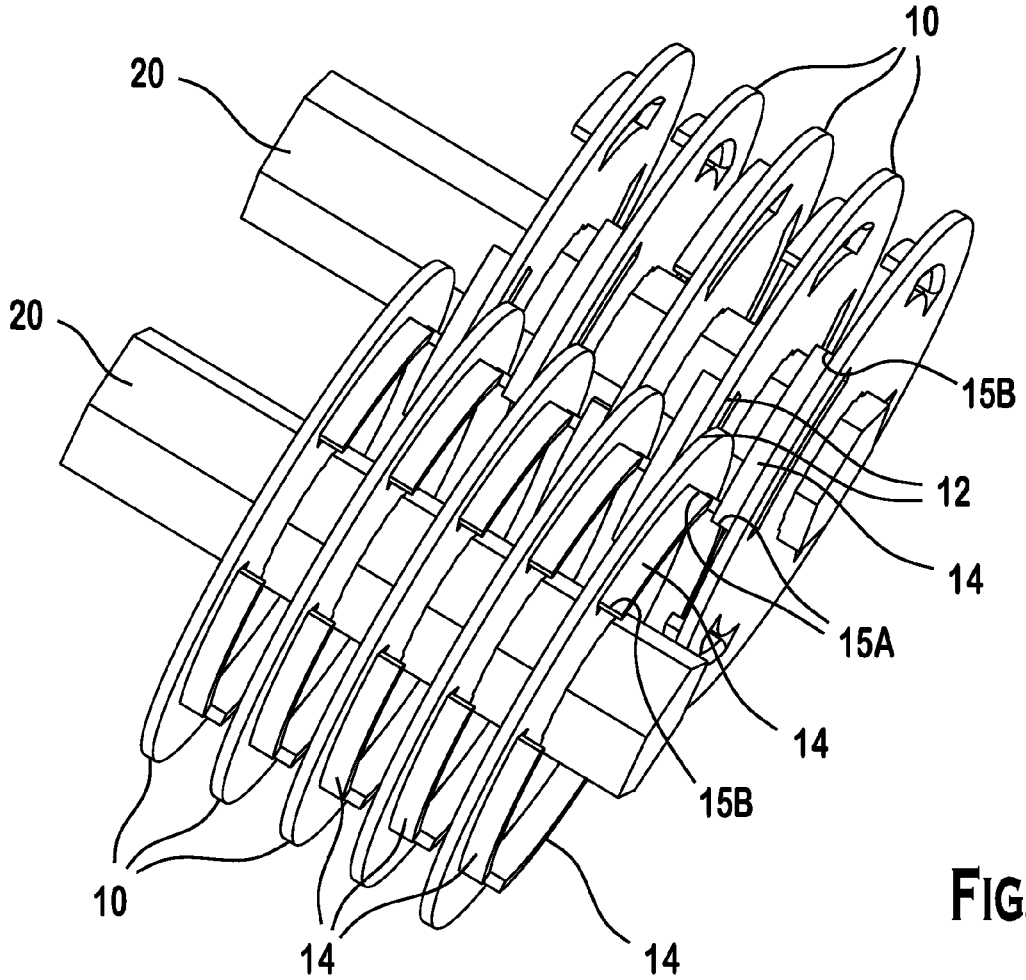
FIG. 5

SHREDDER BLADE AND METHOD OF MANUFACTURING SAME

BACKGROUND

The present invention is generally directed to shredder blades and, more specifically, to a shredder blade capable of cutting material using two different cutting mechanisms.

Conventional shredder blades have a cutting mechanism along an outer perimeter, such as a sharp circumferential edge, serrated edges, or two or more cutting teeth with serrated edges therebetween. All of these shredder blades operate by shredding material into strips. While this method of shredding is considered satisfactory it is sometimes preferred to further shred materials beyond just turning material into strips.

One solution that has been developed is to cross cut material so that the material is shredded into very short segmented strips. This makes it exponentially more difficult to reassemble a shredded document and therefore increases the security of shredded documents. While various techniques have been developed for cross cutting material into smaller segmented strips, the techniques tend to be costly to manufacture.

It may be advantageous to provide a shredder blade that is adapted for cross cutting materials fed into a shredder; that may be readily manufactured; and that preferably cuts materials using two different cutting mechanisms.

SUMMARY

Briefly speaking, one preferred embodiment of the present invention is directed to a shredder a shredder blade adapted to shred material fed into a slot of a shredder head. The shredder blade includes a shredder blade body generally defining a plane and having opposing major surfaces. The shredder blade body has a central bore therethrough adapted for mounting the shredder blade body onto a shredder shaft. The shredder blade body has an outer perimeter. At least a portion of the outer perimeter forms a first cutting mechanism adapted to rotate through a first generally circumferential path located generally at a first radius as measured from a center of the shredder blade body. At least one cutting flange is located on one of the opposing major surfaces of the shredder blade body and extends outwardly therefrom at an angle with the plane. The at least one cutting flange forming a second cutting mechanism adapted to rotate through a second generally circular path located generally at a second radius from the center of the shredder blade body. The second radius is less than the first radius such that the shredder blade is adapted to make a lengthwise cut in the material and also at least partially make at least one cross-cut in the material.

In another aspect, the present invention is directed to a shredder having a plurality of shredder blades for cutting material fed into a slot of a shredder head. The shredder includes a shredder head housing defining a slot adapted to receive material to be shredded. A plurality of shredder blades are disposed within the shredder head housing and are adapted to shred the material inserted into the slot. At least some of the plurality of the shredder blades each include a shredder blade body generally defining a plane and having opposing major surfaces. The shredder blade body has a central bore therethrough adapted for mounting the shredder blade body onto a shredder shaft. The shredder blade body has an outer perimeter. At least a portion of the outer perimeter forms a first cutting mechanism adapted to rotate through a first generally circumferential path located generally at a first radius as measured from a center of the shredder blade body. At least one cutting flange is located on one of the opposing major surfaces of the shredder blade body and extends outwardly therefrom at an angle with the plane. The at least one cutting flange forms a second cutting mechanism adapted to rotate through a second generally circular path located generally at a second radius from the center of the shredder blade body. The second radius is less than the first radius such that the shredder blade is adapted to make a lengthwise cut in the material and also at least partially make at least one cross-cut in the material.

In another aspect, the present invention is directed to a method of manufacturing a shredder blade adapted to shred material fed into a slot of a shredder head. The method includes providing a shredder blade body generally defining a plane and having opposing major surfaces; the shredder blade body having a central bore therethrough adapted for mounting the shredder blade body onto a shredder shaft, the shredder blade body having an outer perimeter, at least a portion of the outer perimeter forms a first cutting mechanism adapted to rotate through a first generally circumferential path located generally at a first radius as measured from a center of the shredder blade body; and pressing portions of the shredder blade body to form at least one punch out therein to form at least one cutting flange located on one of the opposing major surfaces of the shredder blade body and extending outwardly therefrom at an angle with the plane, the at least one cutting flange forming a second cutting mechanism adapted to rotate through a second generally circular path located generally at a second radius from the center of the shredder blade body, wherein the second radius is less than the first radius such that the shredder blade is adapted to make a lengthwise cut in the material while and also at least partially make at least one cross-cut in the material.

BRIEF DESCRIPTION OF THE DRAWINGS

The foregoing summary, as well as the following detailed description of the preferred embodiments of the present invention will be better understood when read in conjunction with the appended drawings. For the purpose of illustrating the invention, there are shown in the drawings embodiments which are presently preferred. It is understood, however, that the invention is not limited to the precise arrangements and instrumentalities shown. In the drawings:

FIG. 4 is a side elevational view of the shredder blades of FIG. 2;

FIG. 5 is a second perspective view of the shredder blades of FIG. 2;

DETAILED DESCRIPTION OF THE PREFERRED EMBODIMENTS

Figure 1:
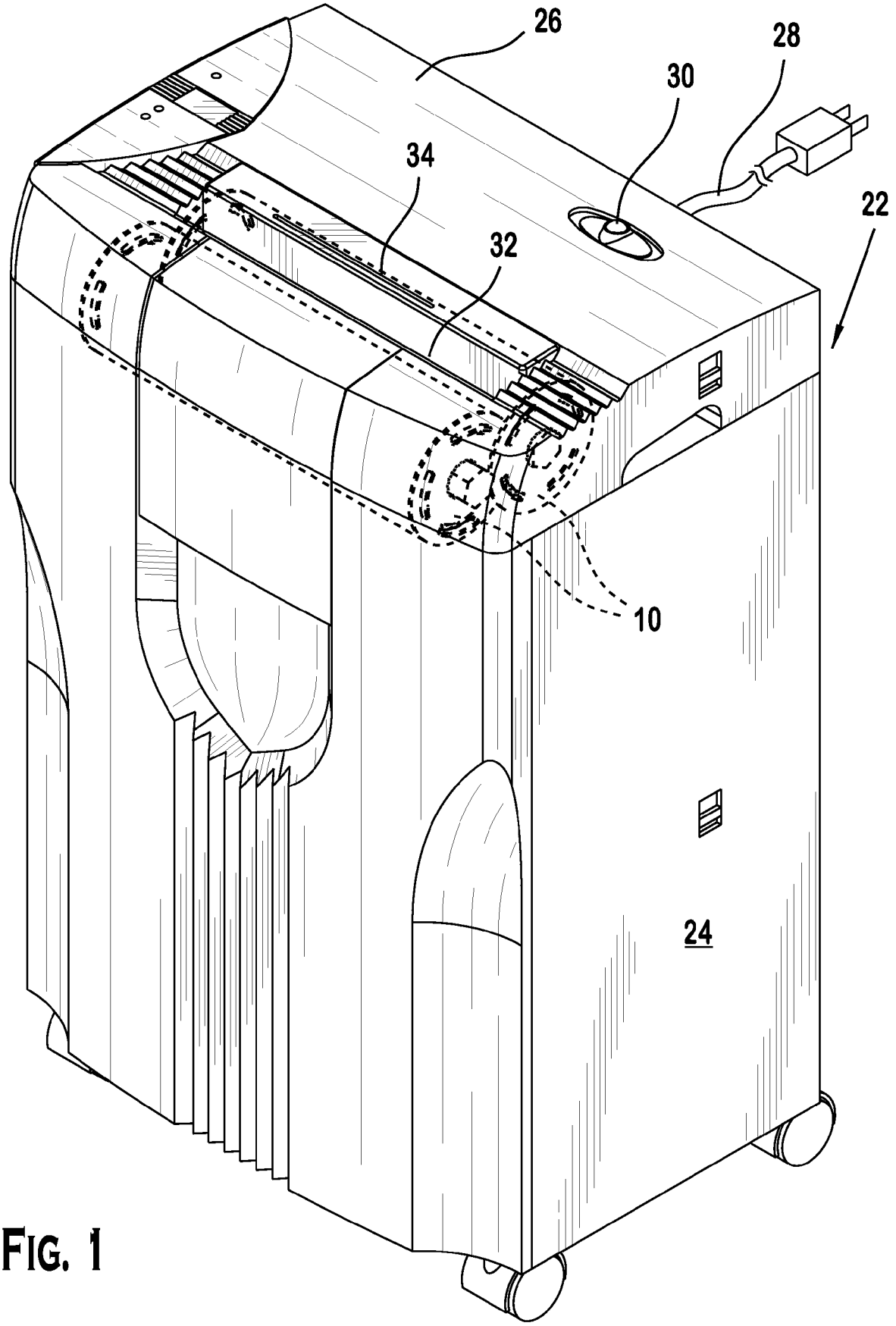
FIG. 1 is a perspective view of a shredder which incorporates shredder blades according to a preferred embodiment of the present invention.
Figure 2:
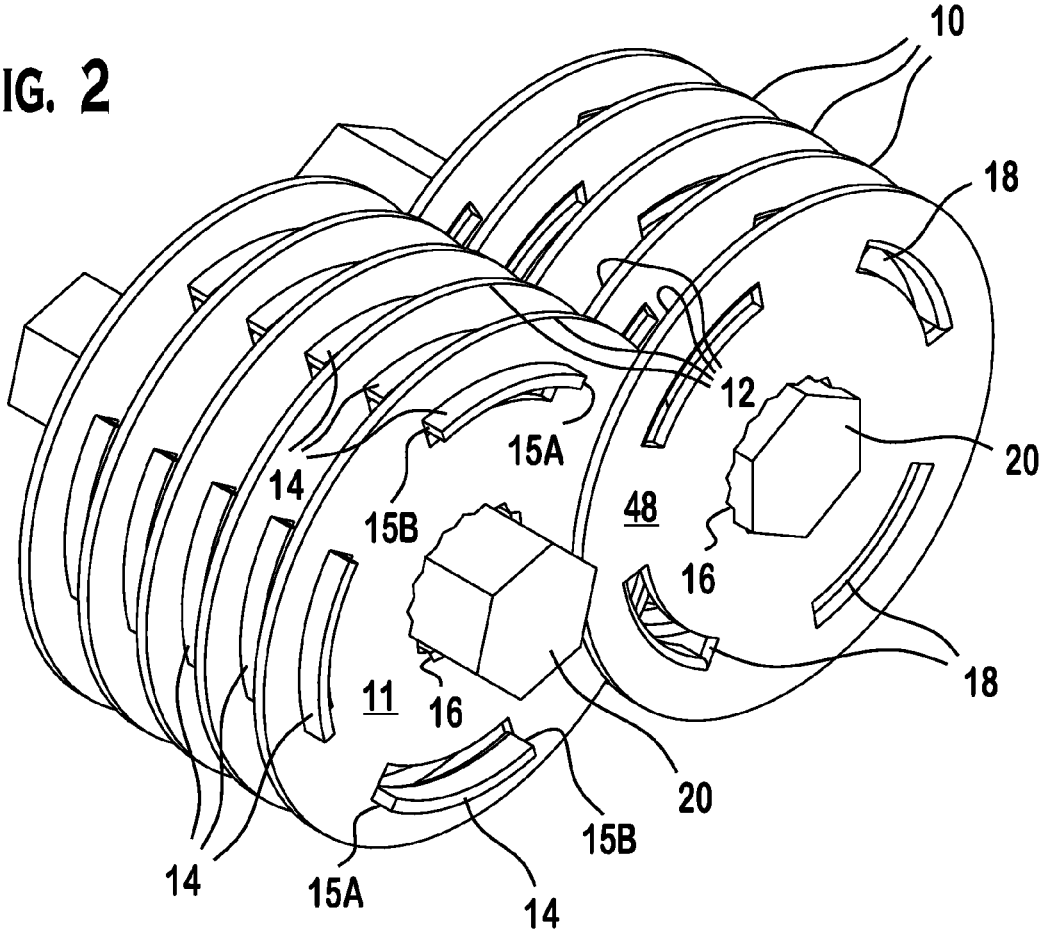
FIG. 2 is a perspective view of shredder blades according to the preferred embodiment of the present invention; at least a portion of the outer perimeter the shredder blades forms a first cutting mechanism; cutting flanges located on a major surface of the cutting blades form a second cutting mechanism.

Certain terminology is used in the following description for convenience only and is not limiting. The words "right," "left," "top," and "bottom" designate directions in the drawings to which reference is made. The words "inwardly" and "outwardly" refer to directions toward and away from, respectively, the geometric center of the shredder blades and designated parts thereof. The language "at least one of 'A', 'B', and 'C'," as used in the claims and in corresponding portions of the specification, means "any group having at least one 'A'; or any group having at least one 'B'; or any group having at least one 'C';—and does require that a group have at least one of each of 'A', 'B', and 'C'." Additionally, the words "a" and "one" are defined as including one or more of the referenced item unless specifically stated otherwise. The terminology includes the words above specifically mentioned, derivatives thereof, and words of similar import.

Referring to FIGS. 1-9, wherein like numerals indicate like elements throughout, there is shown a preferred embodiment of a shredder blade 10 according to the present invention. Briefly speaking, the shredder blade 10 may be manufactured using a punching/stamping process to form a shredding blade that can use two different cutting mechanisms to shred material.

Referring to FIG. 1, one embodiment of the present invention includes a shredder 22 with a shredder head housing 26. The shredder head housing 26 defines at least one slot 32, 34 for inserting material to be shredded. The primary slot 32 guides material to be shredded to shredder blades 10 that are driven by a motor preferably located in the shredder head housing 26. The plurality of shredder blades 10 are disposed within the shredder head housing 26 and are adapted to shred material inserted into one of the slots 32, 34. The first slot 32 is preferably used for paper documents and the second slot 34 is preferably used for more rigid documents, such as credit cards, compact discs, etc.

Figure 6:
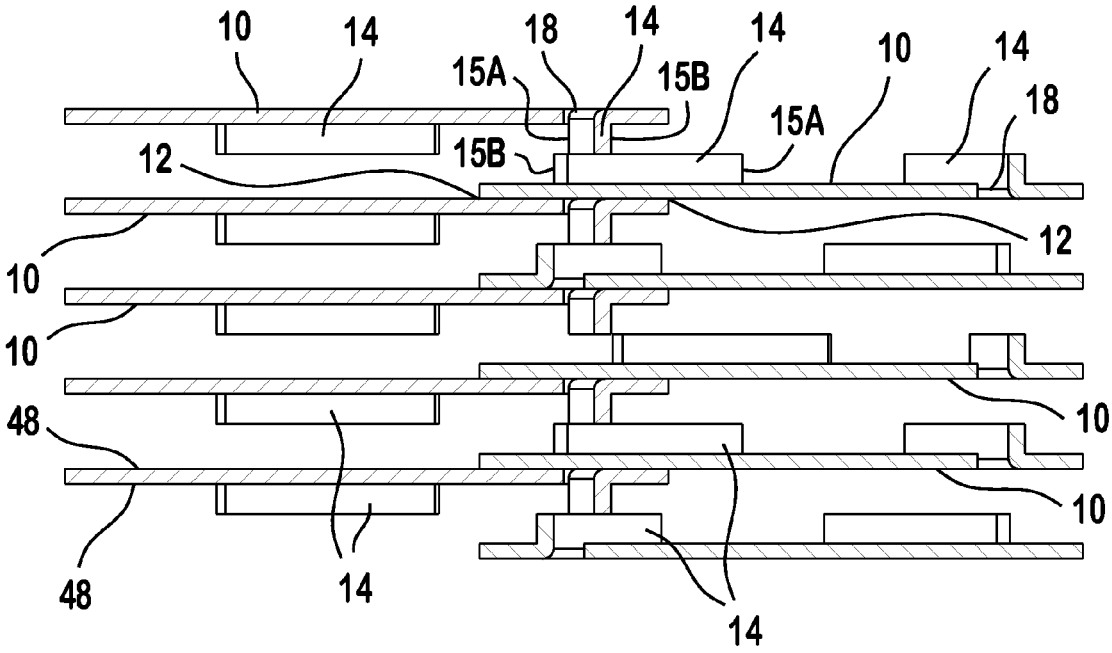
FIG. 6 is a second top plan view of the shredder blades of FIG. 2.
Figure 7:
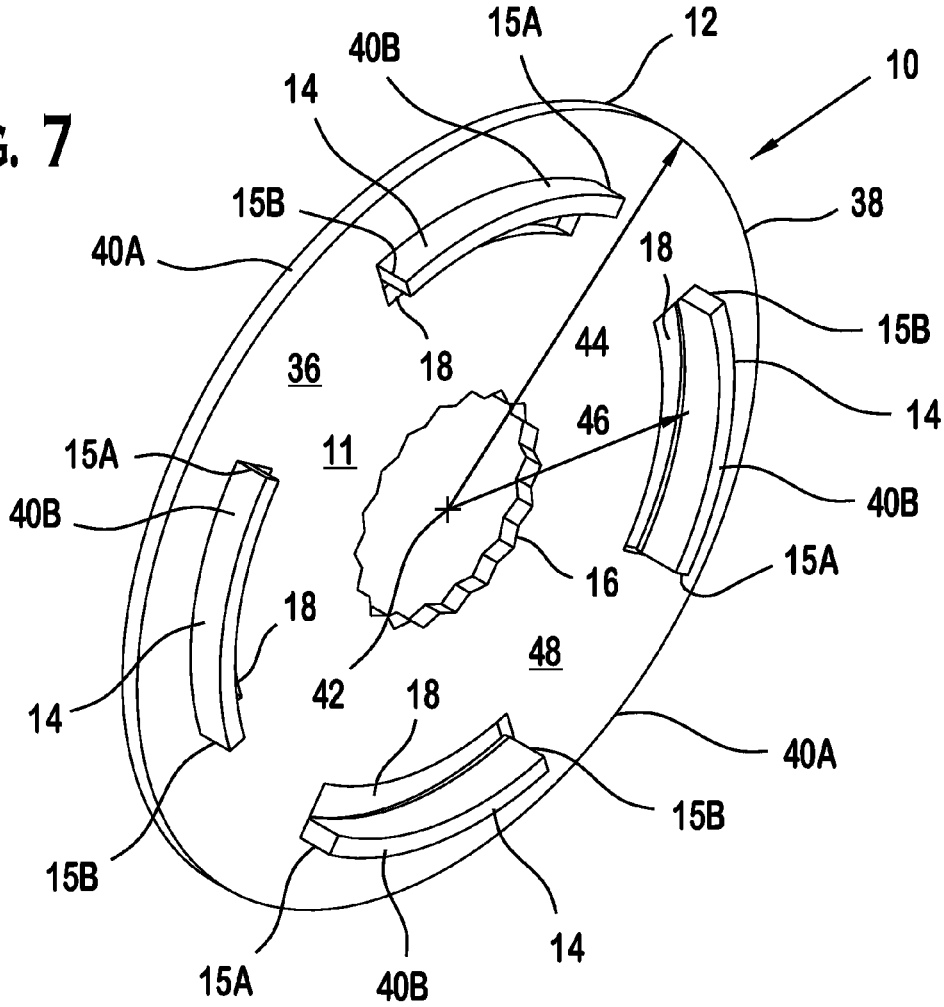
FIG. 7 is a perspective view of a single shredder blade according to the preferred embodiment of the present invention.
Figure 8:
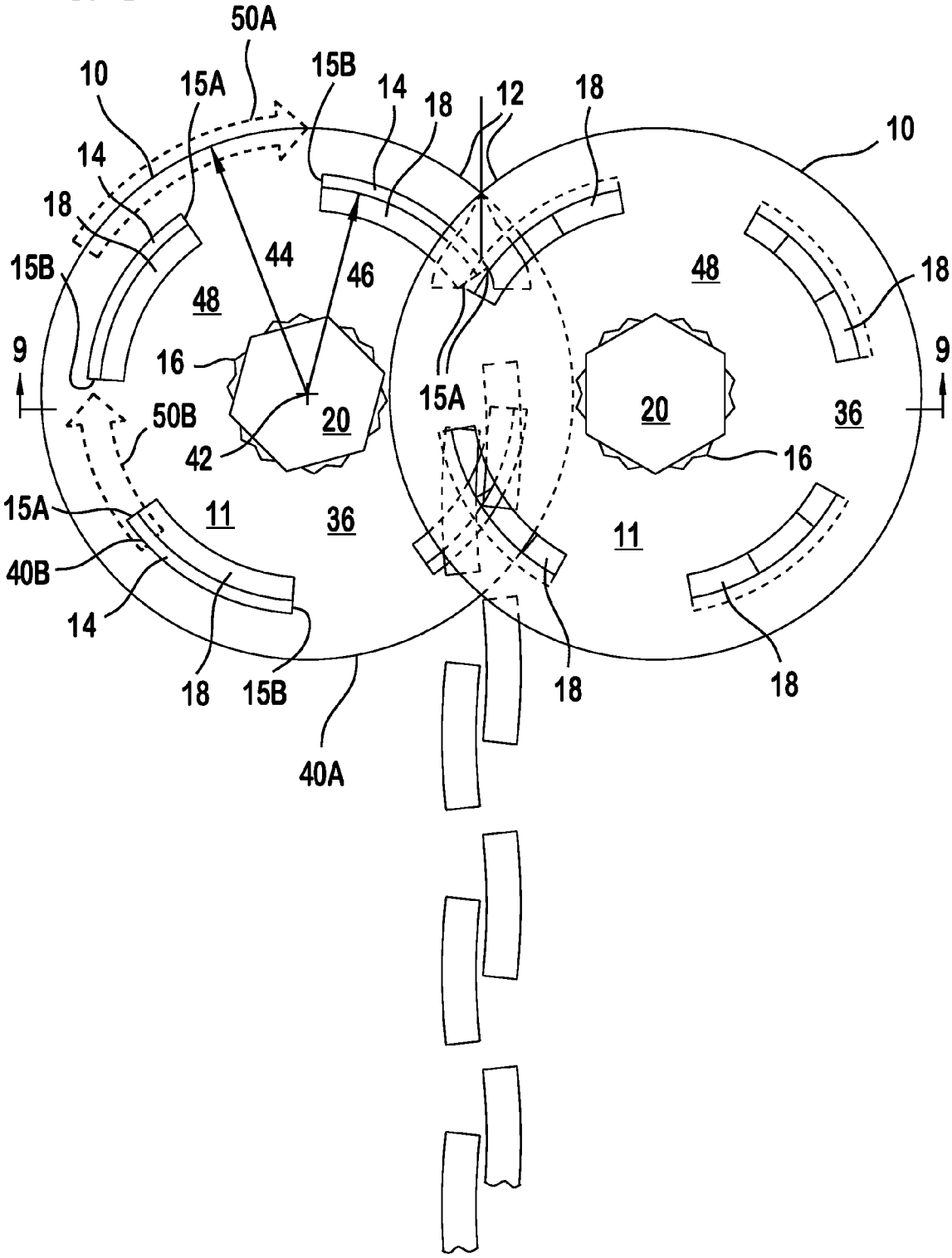
FIG. 8 is a side elevation view of the shredder blades of FIG. 2 illustrating the resulting short segmented strips of shredded material resulting from the lengthwise cuts of the first cutting mechanism and the cross-cuts of the second cutting mechanism.
Figure 9:
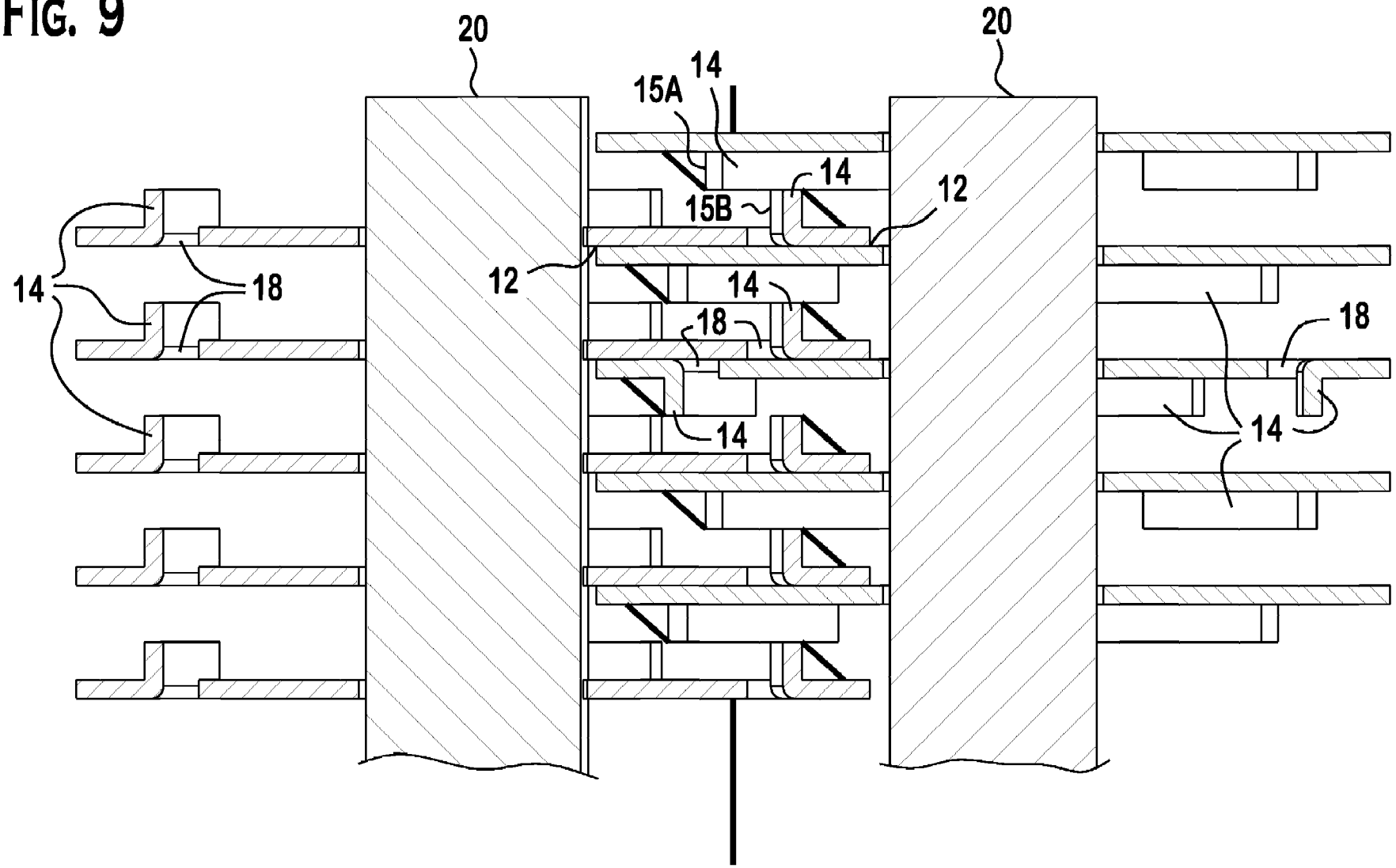
FIG. 9 is a top plan view of a second preferred embodiment of the shredder blades of the present invention.

As best shown in FIGS. 7 and 8, the shredder blades 10 of the present invention preferably include a shredder blade body 11 which is preferably formed by a circular disk. The shredder blade body generally defines a plane 36 and has opposing major surfaces 48. Referring to FIG. 5, the at least one cutting flange is adapted to cut the material while the material is positioned outside of the major surface of the shredder blade body. Referring to FIGS. 6 and 9, it is preferred that a majority of the plurality of shredder blades have at least one major surface that is not in contact with a major surface of an adjacently located shredder blade.

The shredder blade body 11 preferably has a central bore 16 therethrough adapted for mounting the shredder blade body 11 onto a shredder shaft 20. The bore is preferably polygonal to facilitate mounting of the shredder blade 10 onto the shredder shaft 20.

The shredder blade body 11 has an outer perimeter 38. At least a portion of the outer perimeter 38 forms a first cutting mechanism 40A. The outer perimeter 38 is preferably, but not necessarily, circular to form a circumferential cutting edge which forms the first cutting mechanism 40A. Those of ordinary skill in the art will appreciate from this disclosure that any other outer blade profile can be used without departing from the scope of the present invention. For example, the shredder blade 10 can be serrated to form a serrated circumferential cutting surface which forms the first cutting mechanism 40A without departing from the scope of the present invention. Alternatively, the outer perimeter 38 may include one or more cutting teeth which form the first cutting mechanism 40A without departing from the scope of the present invention.

Referring specifically to FIG. 8, the first cutting mechanism 40A is adapted to rotate through a first generally circumferential path 50A (illustrated by the upper arrow show in dashed lines) located generally at a first radius 44 as measured from a center of the shredder blade body 11. When a punching or stamping manufacturing process is used, punch outs 18 will be formed by the portion of the shredder blade body 11 used to make the cutting flange 14.

Referring to FIGS. 7 and 4, at least one cutting flange 14 is located on one of the opposing major surfaces 48 of the shredder blade body 11 and extends generally outwardly therefrom at an angle with the plane 36. It is preferred that the angle is approximately ninety (90) degrees.

The cutting flange(s) 14 are preferably formed by a stamping or punching process. It is preferred that the shredder blade 10 include four cutting flanges 14 that are generally equidistantly spaced along a second generally circular path 50B (illustrated by the lower arrow show in dashed lines in FIG. 8) that is located generally at a second radius 46 of the shredder blade body 11.

Each of the cutting flanges 14 preferably includes a leading, cutting edge 15A and a trailing edge 15B. As shown in FIG. 8, the leading edges 15A are preferably used to place cross-cuts in the material.

Each cutting flange 14 is preferably generally arcuate such that each of the cutting flanges 14 extends along a portion of the second generally circular path 50B. It is also preferred that each of the cutting flanges 14 has a generally rectilinear cross section as measured along a radial cross section of the shredder blade body 11. While the flanges 14 are shown as having a generally constant width (i.e., extending a constant distance from the plane 36 defined by the shredder blade body 11), the width profile can vary without departing from the scope of the present invention. That is the size, thickness, configuration, and shape of the flanges can vary without departing from the scope of the present invention. Similarly, the flanges 14 can be linear or sinusoidal in either width, height or thickness without departing from the scope of the present invention. Similarly, while it is preferred that the shredder blades 10 are made through a punching process, any suitable manufacturing method can be used.

The at least one cutting flange 14 form a second cutting mechanism 40B which is adapted to rotate through the second generally circular path 50B that is located generally at a second radius 46 from the center 42 of the shredder blade body 11. The second radius 46 is less than the first radius 44 such that the shredder blade 10 is adapted to make a lengthwise cut (i.e., the typical lengthwise cuts made in materials that are only shredded into strips) in the material while also at least partially making at least one cross-cut in the material. The cross cut may only be partially made by a flange 14 on single shredder blade 10 since when the blades are paired they may be configured to make a single cross cut using flanges 14 from each of the opposing blades 10. However, depending on the material being shredded, a cross cut may sometimes be formed by a single cutting flange 14 without departing from the scope of the present invention.

Referring still to FIG. 1, one non-limiting embodiment of a shredder using the shredder blades 10 of the present invention is shown for example only. Those of ordinary skill in the art will appreciate that the shredder blades 10 of the present invention can be used in any shredder without departing from the scope of the present invention. While the exemplary shredder head housing 26 has a generally rectilinear shape, those of ordinary skill in the art will appreciate from this disclosure that the shredder head housing 26 can have any shape without departing from the scope of the present invention. The shredder head may also include a bin full indicator or other operational indicators. Shredder head handles are preferably located on the left and right lateral sides of the shredder head housing 26 to allow easy lifting of the shredder head from the shredder basket 24.

The shredder preferably receives power from an outlet via a power conduit, such as an electrical cord, 28. However, the shredder can be powered by batteries or any other suitable power source.

Referring still to FIG. 1, the shredder 10 preferably includes a selectable control 30, such as a power switch, that is in communication with the shredder 22 and has an activated state that is preferably adapted to configure the shredder 22 to automatically activate the plurality of shredder blades 10 when the material is fed into the slot 32, 34.

Figure 3:
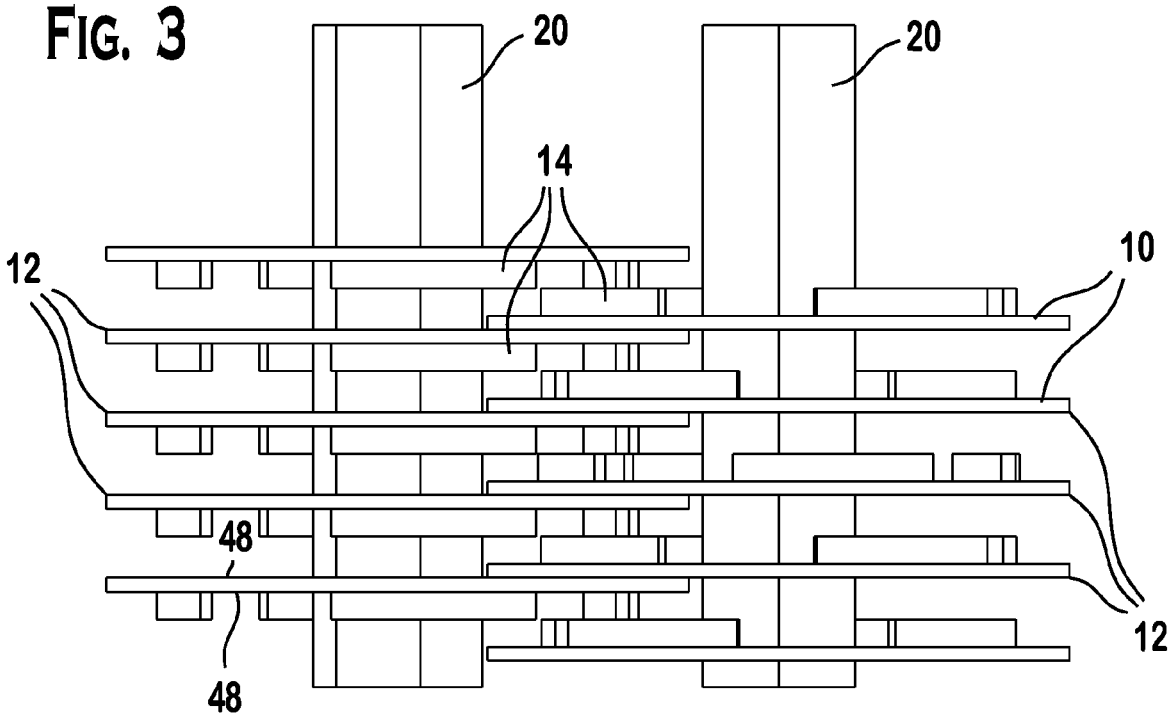
FIG. 3 is a top plan view of the shredder blades of FIG. 2 showing the side-by-side passage of cutting flanges of opposing shredder blades.

FIGS. 3, 5, and 6 illustrate how the cutting flanges 14 on opposing shredder blades 10 pass along side each other in a side by side fashion. Referring to FIG. 8, the leading, cutting edges 15A of the flanges 14 create cross cuts in the material fed to the shredder blades 10. Referring to FIG. 9, depending on the configuration of the shredder blades, the top portion of the flanges 14 can be used to abut and twist a portion of the material fed to the shredder blades. By creating two twists, one in the top of the material strip between opposing blades 10 and one at the bottom of the material strip between the opposing blades, the material is cross cut using a tearing action.

One preferred method of manufacturing the shredder blades 10 of the present invention is as follows. A sheet of material that will be used to form the shredder blades 10 may be punched to form a shredder blade body 11. The provided shredder blade body 11 generally defines a plane 36 and has opposing major surfaces 48. The shredder blade body 11 has a central bore 42 therethrough adapted for mounting the shredder blade body 11 onto a shredder shaft 20. The shredder blade body 11 has an outer perimeter 38. At least a portion of the outer perimeter 38 forms a first cutting mechanism 40A adapted to rotate through a first generally circumferential path 50A located generally at a first radius 44 as measured from a center 42 of the shredder blade body 11. The method also includes pressing portions of the shredder blade body 11 to form at least one punch out 18 therein to form at least one cutting flange 14 located on one of the opposing major surfaces 48 of the shredder blade body 11 and extending outwardly therefrom at an angle with the plane 36. The at least one cutting flange 14 forms a second cutting mechanism 40B adapted to rotate through a second generally circular path 50B located generally at a second radius 46 from the center 42 of the shredder blade body 11. The second radius 46 is less than the first radius 44 such that the shredder blade is adapted to make a lengthwise cut in the material while also at least partially making at least one cross-cut in the material.

It is recognized by those skilled in the art that changes may be made to the above described shredder blades 10 and/or method of making same without departing from the broad inventive concept thereof. For example the shredder blades 10 may include a third cutting mechanism located at a different radius from the first and second cutting mechanisms 40A, 40B without departing from the scope of the present invention. It is understood, therefore, that this invention is not limited to the particular embodiments disclosed, but is intended cover all modifications which are within the spirit and scope of the invention as defined by the above specification, the appended claims and/or shown in the attached drawings.

What is claimed is:

1. A shredder having a plurality of shredder blades adapted to shred material fed into the shredder, comprising:

a plurality of shredder blades disposed within the shredder and adapted to shred material inserted into the shredder, each of the shredder blades comprising:

a shredder blade body generally defining a plane and having opposing major surfaces; the shredder blade body having a central bore therethrough adapted for mounting the shredder blade body onto a shredder shaft, the shredder blade body having an outer perimeter, at least a portion of the outer perimeter forms a first cutting mechanism adapted to rotate through a first generally circumferential path located generally at a first radius as measured from a center of the shredder blade body; and at least one cutting flange located on one of the opposing major surfaces of the shredder blade body and extending outwardly therefrom at an angle with the plane, the at least one cutting flange forming a second cutting mechanism adapted to rotate through a second generally circular path located generally at a second radius from the center of the shredder blade body and adapted to cut the material while the material is outside of the major surface of the shredder blade body, wherein the second radius is less than the first radius such that the shredder blade is adapted to make a lengthwise cut in the material and also at least partially make at least one cross-cut in the material; and wherein the majority of the plurality of shredder blades have at least one major surface that is not in contact with a major surface of an adjacently located shredder blade.

2. The shredder of claim 1, wherein the outer perimeter forms a circumferential cutting edge which forms the first cutting mechanism.

3. The shredder of claim 1, wherein the at least one cutting flange comprises four cutting flanges that are spaced apart along the second generally circular path.

4. The shredder of claim 1, wherein each of the at least one cutting flanges is generally arcuate such that each of the at least one cutting flanges extends along a portion of the second generally circular path.

5. The shredder of claim 4, wherein each of the at least one cutting flanges has a generally rectilinear cross-section as measured along a radial cross section of the shredder blade body.

6. The shredder of claim 5, wherein the outer perimeter of the shredder blade body is serrated to form a circumferential cutting edge which forms the first cutting mechanism.

7. The shredder of claim 4 wherein the angle between each of the at least one cutting flanges and the plane is approximately ninety degrees.

8. A shredder having a plurality of shredder blades for cutting material fed into a slot of a shredder head, comprising:

a shredder head housing defining a slot adapted to receive material to be shredded;

a plurality of shredder blades disposed within the shredder head housing and adapted to shred the material inserted into the slot, a plurality of the shredder blades each comprising:

a shredder blade body generally defining a plane and having opposing major surfaces; the shredder blade body having a central bore therethrough adapted for mounting the shredder blade body onto a shredder shaft, the shredder blade body having an outer perimeter, at least a portion of the outer perimeter forms a first cutting mechanism adapted to rotate through a first generally circumferential path located generally at a first radius as measured from a center of the shredder blade body;

at least one cutting flange located on one of the opposing major surfaces of the shredder blade body and extending outwardly therefrom at an angle with the plane, the at least one cutting flange forming a second cutting mechanism adapted to rotate through a second generally circular path located generally at a second radius from the center of the shredder blade body and adapted to cut the material while the material is positioned outside of the major surface of the shredder blade body, wherein the second radius is less than the first radius such that the shredder blade is adapted to make a lengthwise cut in the material and also at least partially make at least one cross-cut in the material; and wherein the majority of the plurality of shredder blades have at least one major surface that is not in contact with a major surface of an adjacently located shredder blade.

9. The shredder of claim 8, wherein the outer perimeter forms a circumferential cutting edge which forms the first cutting mechanism.

10. The shredder of claim 8, wherein the at least one cutting flange comprises a plurality of cutting flanges that are spaced apart along the second generally circular path.

11. The shredder of claim 8, wherein each of the at least one cutting flanges is generally arcuate such that each of the at least one cutting flanges extends along a portion of the second generally circular path.

12. The shredder of claim 11, wherein each of the at least one cutting flanges has a generally rectilinear cross-section as measured along a radial cross section of the shredder blade body.

13. The shredder of claim 8, wherein the outer perimeter of the shredder blade body is serrated to form a circumferential cutting edge which forms the first cutting mechanism.

* * * * *